US005544555A

United States Patent [19]

Corley et al.

[11] Patent Number: 5,544,555

[45] Date of Patent: Aug. 13, 1996

[54] WRENCH SOCKET

[76] Inventors: Ronald E. Corley; Carol A. Perry, both of 4508 America St., New Orleans, La. 70126

[21] Appl. No.: 447,437

[22] Filed: May 23, 1995

[51] Int. Cl.[6] ..... B25B 13/02

[52] U.S. Cl. ..... 81/125

[58] Field of Search ..... 81/125, 180.1

[56] References Cited

U.S. PATENT DOCUMENTS

| | | | |
|---|---|---|---|
| 3,630,108 | 12/1971 | Stillwagon, Jr. | 81/125 |
| 3,707,894 | 1/1973 | Stillwagon, Jr. | 81/125 |
| 3,808,918 | 5/1974 | Carr | 81/125 |
| 3,834,253 | 9/1974 | Carr | 81/125 |
| 3,835,737 | 9/1974 | Carr | 81/125 |
| 4,663,998 | 5/1987 | Parsons et al. | 81/125 |
| 5,163,345 | 11/1992 | Doan et al. | 81/125 |
| 5,199,334 | 4/1993 | Vasichek et al. | 81/125 |
| 5,259,278 | 11/1993 | Leas | 81/180.1 |
| 5,277,088 | 1/1994 | Vasichek et al. | 81/125 |

FOREIGN PATENT DOCUMENTS

| | | | |
|---|---|---|---|
| 1464808 | 2/1977 | United Kingdom | 81/125 |

*Primary Examiner*—James G. Smith
*Attorney, Agent, or Firm*—Joseph N. Breaux

[57] ABSTRACT

An improved wrench socket of the type having twelve point recesses and suitable for use with fasteners having a tool engagement portion having a plurality of substantially planar engagement surfaces having at least one elongated magnetic member secured to at least one surface partially defining a point recess of the socket, the magnetic member being shaped in a manner such that at least a portion of each magnetic member extends up to a line drawn between a first and second edge of the point recess. The term "edge of the point recess" is used herein to refer to the portion of the socket formed by the convergence of one side of a first point recess with a side of a second point recess.

20 Claims, 3 Drawing Sheets

WRENCH SOCKET

TECHNICAL FIELD

The present invention relates to wrench sockets having a mechanism for maintaining a fastener in connection with the wrench socket tool and more particularly to wrench sockets that utilize magnetic forces to maintain a fastener in connection with the wrench socket.

BACKGROUND ART

A continuing need exists, when installing fasteners, to maintain the fastener in connection with the fastening tool until the fastener has been fastened. As a result of this continuing need, various types of magnetic keeper accessories have been devised for converting wrench sockets not equipped with magnetic fastener retaining mechanisms into wrench sockets equipped with magnetic fastener retaining mechanisms. Many of the approaches require installing a magnet at the bottom of the wrench socket through the use of clips, to entrap the magnet in place, or the use of an interference fit, accomplished by constructing the magnet from an elastomeric magnetic material or securing an elastomeric material to the magnetic material.

Positioning the magnetic material at the bottom of the wrench socket results in a magnetic keeper mechanism that pulls the fastener as far as possible into the wrench socket, and, thus, minimizes the extension of the fastener from the socket. Although minimal extension of the fastener from the wrench socket may not be a disadvantage in all fastening situations, there are situations, such as in a limited or confined area, where even a slightly greater extension of the fastener from the wrench socket can ease installation of the fastener. It would, therefore, be desirable to have a wrench socket that included a magnetic fastener retaining mechanism that allowed a user to position the fastener in selected position with respect to the wrench socket and that maintained the fastener in the user selected position through magnetic forces.

GENERAL SUMMARY DISCUSSION OF INVENTION

It is thus an object of the invention to provide a wrench socket that allows a user to position a fastener at a user selected position with respect to the wrench socket.

Accordingly, an improved wrench socket of the type having twelve point recesses and suitable for use with fasteners having a tool engagement portion having a plurality of substantially planar engagement surfaces is provided. The term "point recess" is used herein to mean a recess formed by the convergence of two substantially planar surfaces so as to form a point radiating away from the center of the socket aperture. The term "planar engagement surface" is used herein to describe the side surfaces of a nut or a bolt-head type fastener, that has a polygonally shaped cross-section, against which a wrench or other fastening tool acts during the fastening process. The improvement comprises a wrench socket of the type described herein above having at least one elongated magnetic member secured to at least one surface partially defining a point recess of the socket, the magnetic member being shaped in a manner such that at least a portion of each magnetic member extends up to a line drawn between a first and second edge of the point recess. The term "edge of the point recess" is used herein to refer to the portion of the socket formed by the convergence of one side of a first point recess with a side of a second point recess.

The magnetic member may have any cross-sectional shape that allows a portion of each magnetic member to extend up to a line drawn between a first and second edge of the point recess. However, the magnetic member preferably has a triangular cross-sectional shape, and more preferably have a triangular cross-sectional shape in which one of the angle is between 110 and 130 degrees.

The magnetic member is preferably constructed from an elastomeric magnetic material, although the magnetic member may be constructed from any magnetic-material. In addition, the magnetic member is preferably secured to at least one of the side surfaces with an adhesive and of a length substantially equal to the depth of the socket.

Although one magnetic member is sufficient to practice the invention, it is preferred to include at least one pair of magnetic members. The pair may be disposed in an opposed configuration, wherein five point recesses lie between the pair in either direction; an adjacent configuration, wherein one point recess is disposed between the pair of magnetic members in a first direction, and nine point recesses are disposed between the pair in a second direction; or a hybrid configuration, wherein three point recess are disposed between the pair of magnetic members in a first direction, and seven point recesses are disposed between the pair in a second direction. Of course more than one pair of magnetic members may be utilized to practice the invention, and a pair or pairs of magnetic members may be utilized in combination with a single magnetic member to practice the invention.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
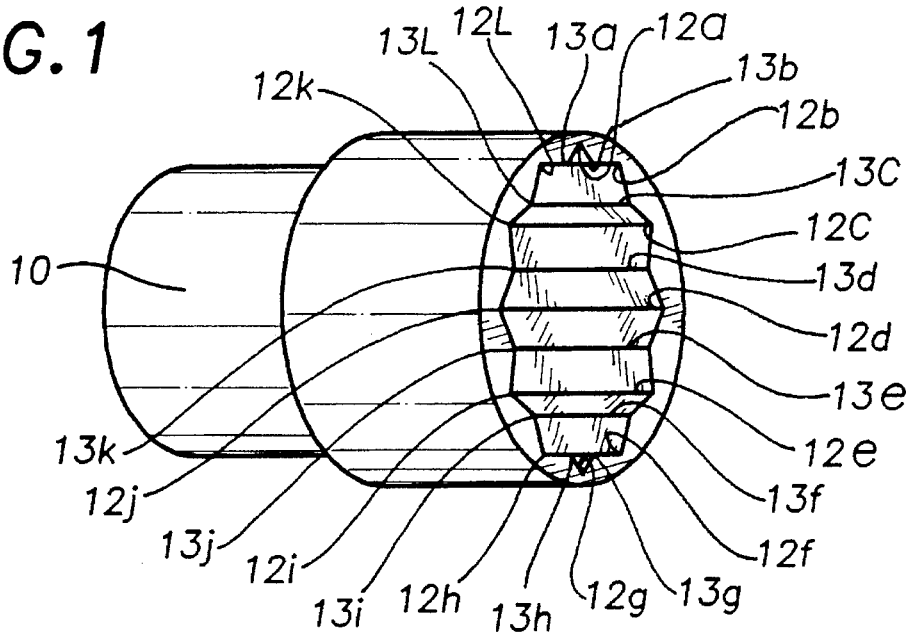
FIG. 1 is an isometric view of a representative wrench socket having twelve point recesses of the type to which the improvement of the invention is applicable.
Figure 1A:
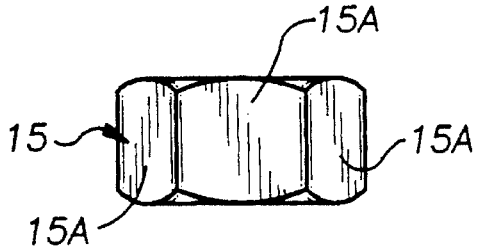
FIG. 1*a* is a side view of a nut.

FIG. 1 is an isometric view of a representative wrench socket 10 having twelve point recesses 12*a*–12L and twelve edges 13*a*–13L of the type to which the improvement of the invention is applicable. FIG. 1A is a side view of a hex-nut 15 that is representative of the fasteners with which the improved wrench socket of the invention may be utilized. Shown in the figure are three of hex-nut 15's six planar engagement surfaces 15*a*.

Figure 2:
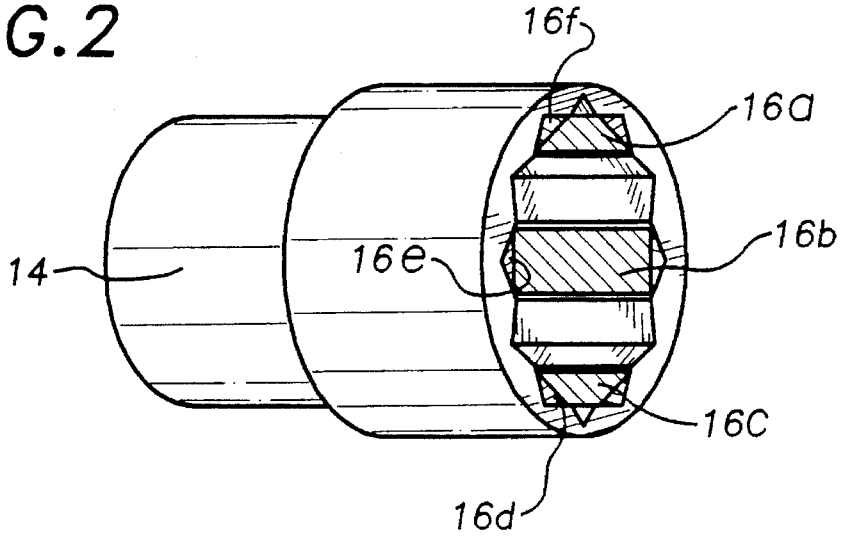
FIG. 2 is an isometric view of an exemplary embodiment of the improved wrench socket of the invention.

FIG. 2 is an isometric view of an exemplary embodiment of the improved wrench socket 14 of the invention including includes six magnetic members 16*a*–16*f*. As shown in the Figure magnetic members 16*a*–16*f* are installed within every other point recess 12 of wrench socket 14. This installation configuration preserves the hexagonal shaped cross-section required for the wrench socket to be utilized with fasteners having tool engagement portions having hexagonal shaped cross-sections.

Figure 3:
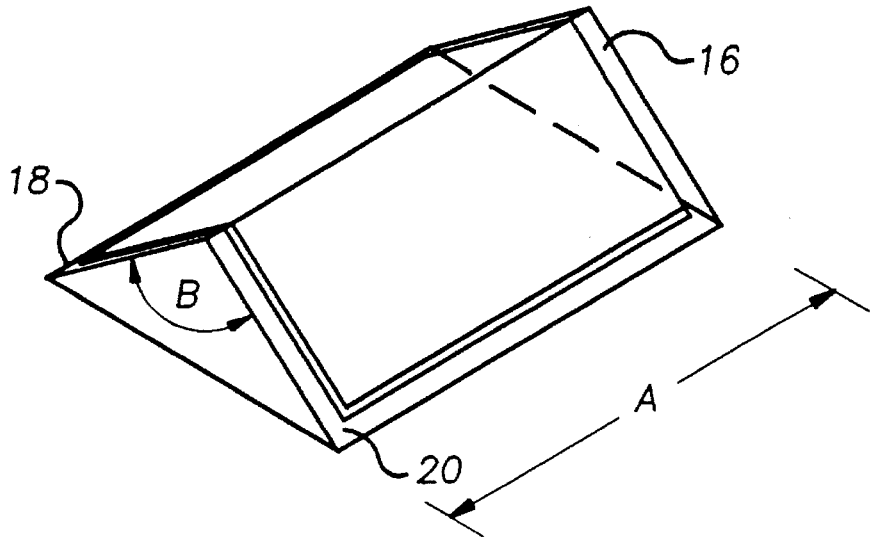
FIG. 3 is an isometric view of an exemplary embodiment of the magnetic member of the invention.

FIG. 3 is an isometric view of an exemplary embodiment of a magnetic member 16. In this embodiment, magnetic member 16 has a length "A" substantially equal to the depth of wrench socket 14, has a triangular shaped cross-section, and is constructed from an elastomeric magnetic material. Magnetic member 16 includes two shorter sides 18,20 attached at an angle "B" of about 120 degrees. Each side 18,20 is coated with an adhesive that is used to secure magnetic member 16 in place.

Figure 4:
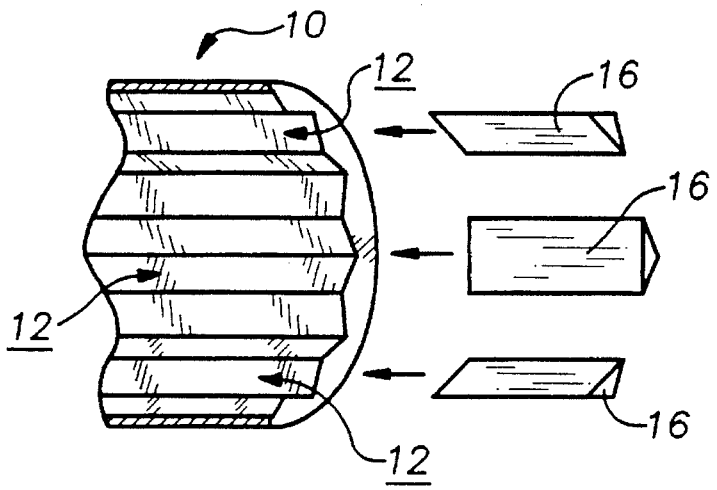
FIG. 4 is a detail cut-away view of the representative wrench socket of FIG. 1 showing installation of three magnetic members.
Figure 5:
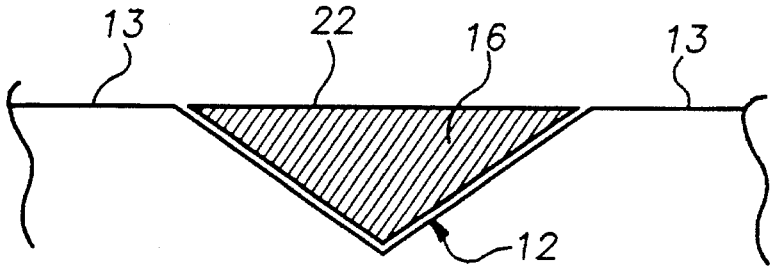
FIG. 5 is a top detail view of a magnetic member installed within one of the point recesses of the improved wrench socket of FIG. 2.

FIG. 4 is a detail cut-away view of representative wrench socket 10 showing installation of three magnetic members 16 within three point recesses 12. FIG. 5 is a top detail view of a magnetic member 16 installed within one of the point recesses 12. As shown in the Figure, the longest side 22 is flush with an imaginary line drawn between the two edges 13 adjacent point recess 12. Positioning a portion of magnetic member 16 at this location allows the magnetic force of magnetic member 12 to contact and hold a planar engagement surface 15*a*, such as shown in FIG. 1A, of a fastener in a desired position.

Figure 6:
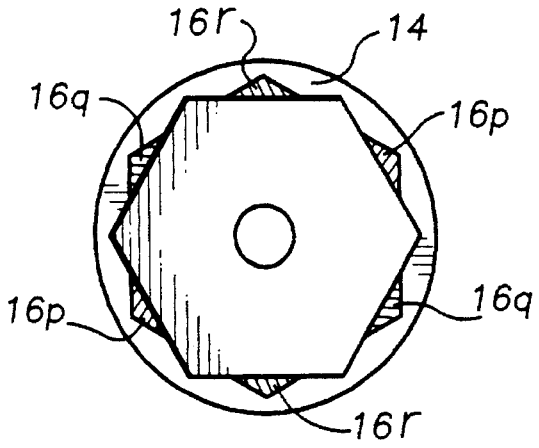
FIG. 6 is a top view of the improved wrench socket of FIG. 2.
Figure 7:
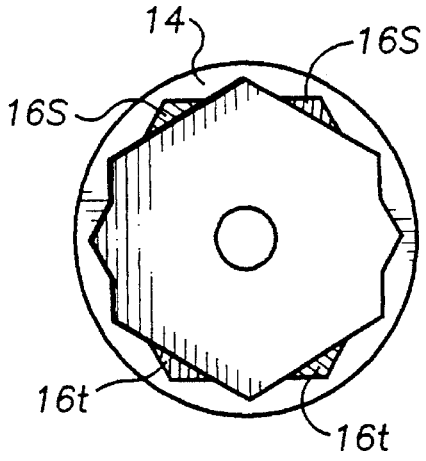
FIG. 7 and FIG. 7*a* are a top view of a top view of a second exemplary embodiment of the improved wrench socket having two pairs of magnetic members.
Figure 7A:
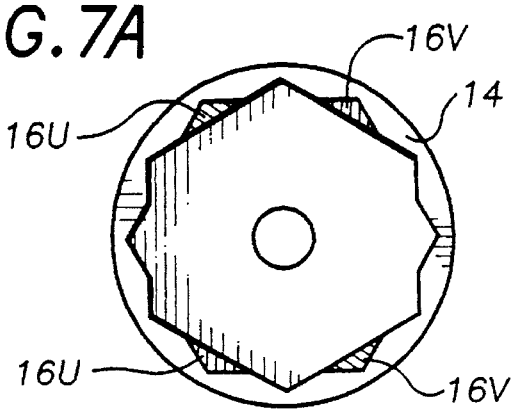
Figure 8:
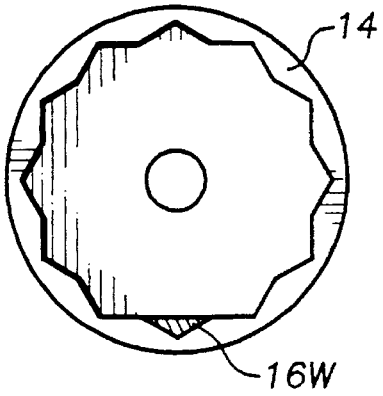
FIG. 8 is a top view of a third exemplary embodiment of the improved wrench socket utilizing a single magnetic member.
Figure 9:
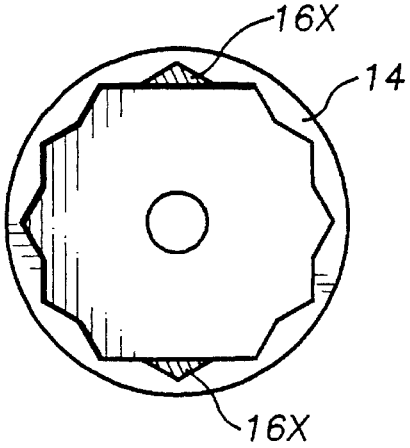
FIG. 9 is a top view of a fourth exemplary embodiment of the improved wrench socket utilizing a pair of magnetic members.

FIGS. 6–9 illustrate various configuration in which the magnetic members may be attached to .wrench socket 14. FIG. 6 is a top view of an improved wrench socket 14 having three pairs of opposed magnetic members 16*p*, 16*q*, 16*r*. FIG. 7 is a top view of a top view of a second exemplary embodiment of the improved wrench socket 14 having two pairs of magnetic members labeled 16*s*, 16*t* that may be described as disposed in an adjacent configuration. FIG. 7 A is a top view of the same exemplary embodiment as shown in FIG. 7 with the two pairs of magnetic members labeled 16*u*, 16*v* that may be described as being in the hybrid configuration. FIG. 8 is a top view of a third exemplary embodiment of the improved wrench socket 14 that utilizes a single magnetic member 16*w*. FIG. 9 is a top view of a fourth exemplary embodiment of the improved wrench socket 14 that utilizes a single opposed pair of magnetic members 16*x*.

Use of improved wrench socket 14 is simple. The fastener is simply placed within the socket at a desired position.

It can be seen from the preceding description that an improved wrench socket that allows a user to position a fastener at a user selected position with respect to the wrench socket has been provided.

It is noted that the embodiments of the improved wrench socket described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. In a wrench socket of the type having an interior aperture having a twelve point cross-sectional shape, the improvement comprising:

at least one elongated magnetic member secured to at least one surface partially defining a point recess of said socket, said magnetic member being shaped in a manner such that at least a portion of each said magnetic member extends up to a line drawn between a first and second edge of said point recess.

2. The improved wrench socket of claim 1, wherein:

said magnetic member has a substantially triangular cross-sectional shape.

3. The improved wrench socket of claim 2, wherein:

said substantially triangular cross-sectional shape has an angle between 110 and 130 degrees.

4. The improved wrench socket of claim 1 wherein:

said magnetic member is constructed from an elastomeric magnetic material.

5. The improved wrench socket of claim 4, wherein:

said magnetic member has a substantially triangular cross-sectional shape.

6. The improved wrench socket of claim 5, wherein:

said magnetic member is secured to said surface with an adhesive.

7. The improved wrench socket of claim 5, wherein:

said substantially triangular cross-sectional shape has an angle between 110 and 130 degrees.

8. The improved wrench socket of claim 7, wherein:

said magnetic member is secured to said surface with an adhesive.

9. The improved wrench socket of claim 1 wherein said socket includes:

a first magnetic member secured to a first surface partially defining a first point recess of said socket, and a second magnetic member secured to a second surface partially defining a second point recess of said socket, said socket having five point recesses disposed between said first point recess and said second point recess.

10. The improved wrench socket of claim 9, wherein:

said magnetic member has a substantially triangular cross-sectional shape.

11. The improved wrench socket of claim 9 wherein:

said magnetic member is constructed from an elastomeric magnetic material.

12. The improved wrench socket of claim 11, wherein:

said magnetic member has a substantially triangular cross-sectional shape.

13. The improved wrench socket of claim 1 wherein said socket includes:

a first magnetic member secured to a first surface partially defining a first point recess of said socket, and a second magnetic member secured to a second surface partially defining a second point recess of said socket, said socket having one point recess disposed between said first point recess and said second point recess in a first direction, and nine point recess disposed between said first point recess and said second point recess in a second direction.

14. The improved wrench socket of claim 13, wherein:

said magnetic member has a substantially triangular cross-sectional shape.

15. The improved wrench socket of claim 13 wherein:

said magnetic member is constructed from an elastomeric magnetic material.

16. The improved wrench socket of claim 15, wherein:

said magnetic member has a substantially triangular cross-sectional shape.

17. The improved wrench socket of claim 1 wherein said socket includes:

a first magnetic member secured to a first surface partially defining a first point recess of said socket, and a second magnetic member secured to a second surface partially defining a second point recess of said socket, said socket having three point recesses disposed between said first point recess and said second point recess in a first direction, and seven point recesses disposed between said first point recess and said second point recess in a second direction.

18. The improved wrench socket of claim 17, wherein:

said magnetic member has a substantially triangular cross-sectional shape.

19. The improved wrench socket of claim 17, wherein:

said magnetic member is constructed from an elastomeric magnetic material.

20. The improved wrench socket of claim 19, wherein:

said magnetic member has a substantially triangular cross-sectional shape.

* * * * *